United States Patent [19]

von den Benken et al.

[11] 4,131,965

[45] Jan. 2, 1979

[54] MACHINE TO WORK ON SHOE SOLES

[76] Inventors: Henry von den Benken; Elisabeth von den Benken, both of 2212 Centre St., West Roxbury, Mass. 02132

[21] Appl. No.: 853,026

[22] Filed: Nov. 21, 1977

Related U.S. Application Data

[63] Continuation-in-part of Ser. No. 711,158, Aug. 3, 1976, abandoned.

[51] Int. Cl.[2] ..... A43D 7/00; A43D 119/00; B25C 5/00

[52] U.S. Cl. ..... 12/86.7; 12/17.2; 227/104

[58] Field of Search ..... 12/77, 77.5, 86.65, 12/86.5, 86.7, 87, 88, 91–95, 17 R, 17.2; 227/104

[56] References Cited

U.S. PATENT DOCUMENTS

| | | | |
|---|---|---|---|
| 34,170 | 1/1862 | Taggart | 227/104 |
| 36,292 | 8/1862 | Gallahue | 227/104 |
| 206,671 | 8/1878 | Helms | 12/86.5 |
| 516,676 | 3/1894 | Crane | 12/86.7 |
| 884,215 | 4/1908 | Sohov | 227/104 |
| 2,264,416 | 12/1941 | Topham | 12/17.2 |
| 2,293,080 | 8/1942 | Ray | 12/17.2 |
| 3,487,488 | 1/1970 | Rosberg | 12/86.7 |

*Primary Examiner*—Patrick D. Lawson
*Attorney, Agent, or Firm*—Albert Gordon

[57] ABSTRACT

A machine to work on shoe soles has a holding fixture to automatically guide a sole along the work tool. The holding fixture consists of an endless track which can be adjusted according to the length of the shoe and clamping motors which press the shoe sole against a straight crossbar. The holding fixture is suspended by a linkage and can rotate around a vertical shaft.

8 Claims, 8 Drawing Figures

MACHINE TO WORK ON SHOE SOLES

CROSS-REFERENCE TO RELATED APPLICATION

This is a continuation-in-part of application Ser. No. 711,158 filed Aug. 3, 1976, now abandoned.

BACKGROUND AND SUMMARY OF THE INVENTION

U.S. Pat. Nos. 34170, 36292, 206671, and 884215 are illustrative of prior art machines for moving a workpiece past a workpiece treating means. Each of the prior art mechanisms include a fixture adapted to support the workpiece; means mounting the fixture for universal movement in a prescribed plane, a workpiece treating means so located as to treat a part of the workpiece proximate to the workpiece periphery as the workpiece part moves past the workpiece treating means; and drive means effective to so move the fixture in the prescribed plane as to move successive segments of the workpiece part past the workpiece treating means.

U.S. Pat. Nos. 34170 and 884215 disclose an adjustable track mounted to the fixture that so coacts with the drive means that the extent of lengthwise movements of the fixture to move lengthwise portions of the workpiece part past the workpiece treating means may be varied by adjusting the lengthwise dimension of the track in accordance with the lengthwise dimension of the workpiece. In accordance with a first aspect of this invention, these prior art mechanisms are improved so as to provide locating members that are adjustable so as to be spaced from each other an amount that is related to the lengthwise adjustment of the track to thereby enable the workpiece to be automatically positioned on the fixture in a position appropriate to the length of the workpiece and to the extent of lengthwise movements of the workpiece past the workpiece treating means. This is accomplished by making the adjustable track in the form of a pair of track sections having facing concave end portions and overlapping finger portions that extend from opposite ends of the concave end portions, as in U.S. Pat. No. 34170, and in providing a locating plate that is mounted to each concave track portion and that extends upwardly of the fixture.

A second aspect of the invention deals with an improved drive means that is cooperative with the track to move the fixture as described above regardless of the lengthwise adjustment of the track. This is accomplished by making the overlapping finger portions offset from each other and by making the drive means in the form of rollers engagable with opposite sides of the track sections.

A third aspect of the invention deals with an improved arrangement for clamping the workpiece to the fixture in flattened condition. The machine, in accordance with this aspect of the invention, includes a hold-down bar, having a flat bottom and a prescribed length, that is adapted to bear against the top of the workpiece. The fixture has a plurality of plungers mounted thereto for heightwise movement that are located side by side beneath the hold-down bar and have an overall length corresponding to the prescribed length of the hold-down bar. Means are provided for initially maintaining the plungers in lower positions and for then yieldably urging the plungers upwardly to thereby press the workpiece against the flat bottom of the hold-down bar and thus flatten the workpiece against the hold-down bar. The hold-down bar is mounted for universal movement in a plane parallel to the plane of movement of the fixture.

A fourth aspect of the invention is concerned with an improved arrangement for mounting the fixture for universal movement in the prescribed plane in such a way as to properly balance the fixture during this movement. This arrangement comprises a link to which the fixture is mounted for rotary movement about a heightwise axis that intersects the fixture proximate to its center of mass and that is at right angles to the plane of movement of the fixture, and linkage swingably connecting the link to a fixed structure.

DESCRIPTION OF THE PREFERRED EMBODIMENT

Figure 1:
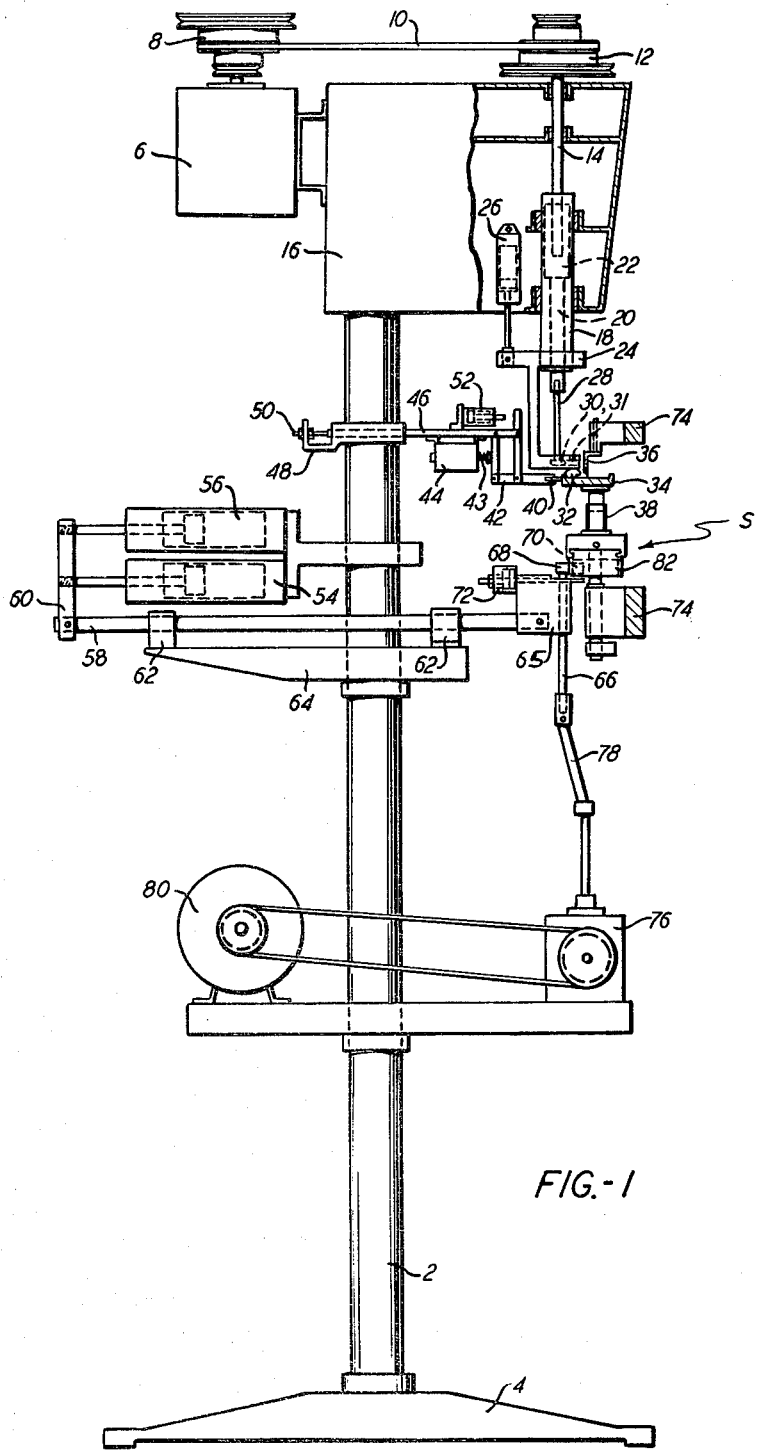
FIG. 1 is a side elevation of the machine.

The novelties of this invention have been incorporated in a roughing machine for shoe soles as shown in FIG. 1. Valves, switches and power lines have been omitted from FIG. 1 and some parts have been cut away in order to maintain clarity of the drawing. Furthermore, the drive means of the roughing machine are not subject of this invention and will be referred to only when necessary to explain the function of novel sections. All functional modules are mounted to a column 2 which is resting in a stand 4. Electrical motor 6 is mounted to housing 16 and drives the spline shaft 14 via pulley 8, V-belt 10 and pulley 12. The spline shaft 14 is rotatively located in housing 16. Also in housing 16 is located slide 18 which can move vertically, only. In slide 18 is rotatively located roughing spindle 20 with hub 22. Hub 22 has a bore and grooves which fit the splines of spline shaft 14. The arrangement is such that the roughing spindle 20 can move up or down but still maintain a positive engagement with the spline shaft 14. A bracket 24 is firmly clamped to the slide 18. Connected to the bracket 24 is the piston rod of an air motor 26 which is mounted to the housing 16. An extension shaft 28 is firmly connected to the roughing spindle 20 by means of a screw. The extension shaft 28 terminates in the bottom part of bracket 24 where it drives a pair of spur gears 30 and 31. The bottom part of bracket 24 is shaped like a housing to provide proper bearings for the spur gears 30 and 31. The roughing tool 32 is connected to the hub of spur gear 31. It is detachable. In FIG. 1, the roughing tool 32 is shown in contact with shoe sole 34 which is forced against the crossbar 36 by means of the clamping motors 38. The crossbar 36 does not change its vertical height, however the roughing tool 32 can move up or down due to the action of motor 26.

Figure 6:
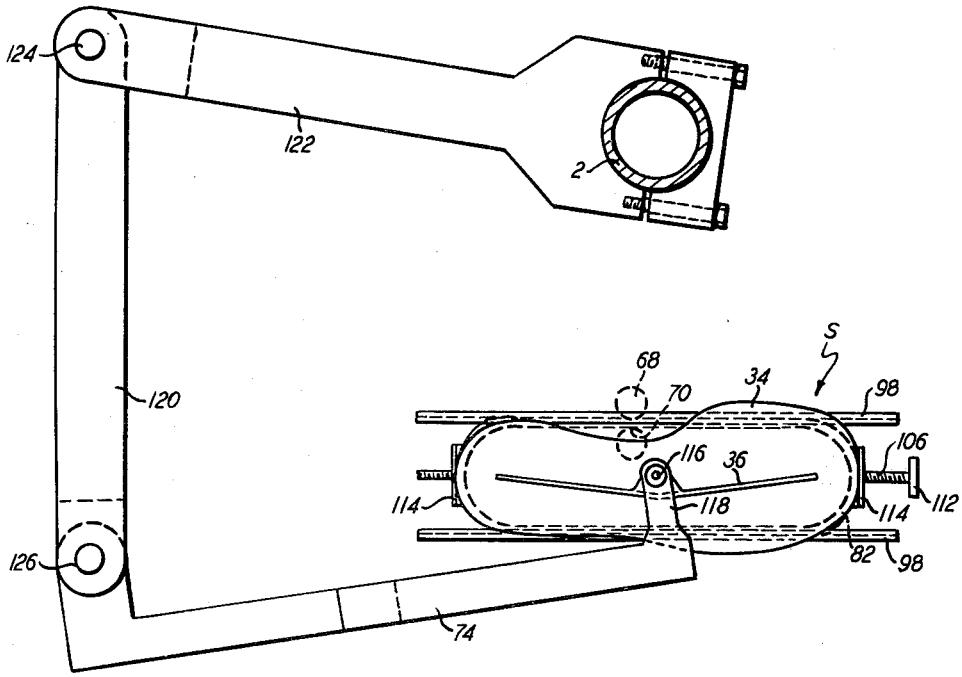
FIG. 6 is a side elevation of the means mounting the fixture for universal movement in the prescribed plane.
Figure 7:
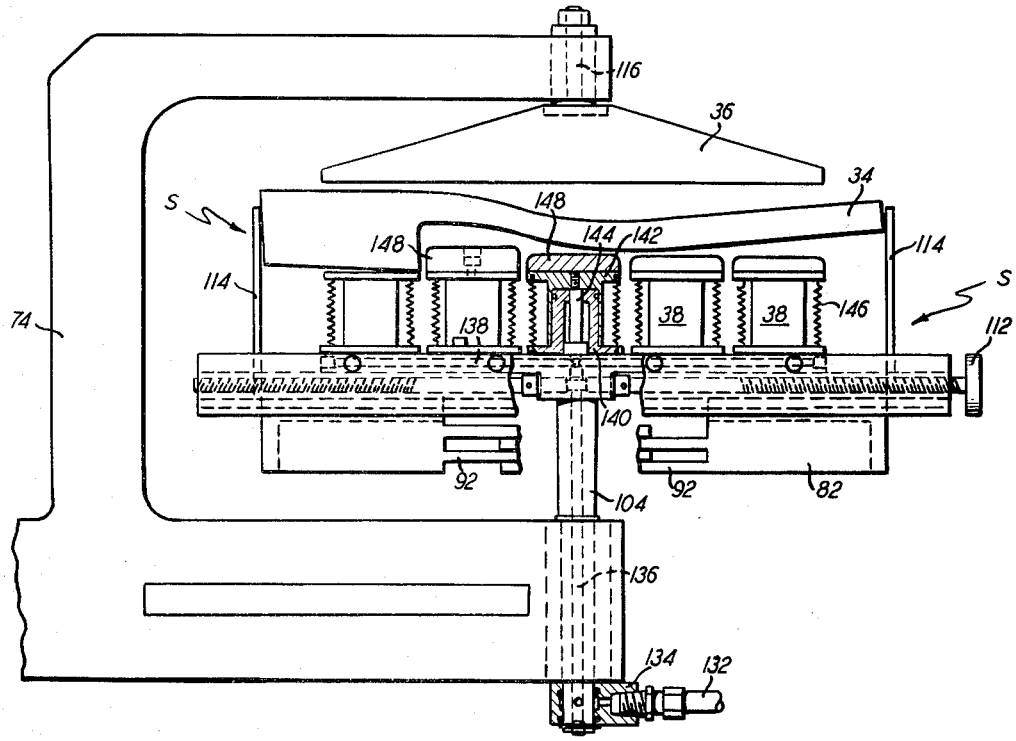
FIG. 7 is a partially sectional side view of the fixture and of the hold-down bar.

Between the roughing tool and the column of the machine is a sensing unit consisting of a sensing roll 40, four-bar linkage 42, sensing valve 44, sensing slide 46, clamp 48, screw adjustment 50 and positioning motor 52. FIG. 1 shows the sensing unit in an operating position, i.e. spring 43 of sensing valve 44 pushes the sensing roll 40 via freely moving four-bar linkage 42 against the edge of the sole 34. Thus, sensing roll 40 is always trying to follow the contour of the sole. In operation, the sensing roll is kept in a neutral position; any deviation from the neutral position, due to the changing contour of the sole, is signalled to the guide motor 54. According to the signal received, guide motor 54 will correct the deviation of the sensing roll 40 immediately. This action will be described explicitly later on in this specification. Firmly connected to the guide motor 54 by means of connector 60 are shock absorber 56 and a pair of guide bars 58. The pair of guide bars 58 slide in bearings 62 which are mounted on bracket 64. Said bracket is mounted on column 2. The ends of the guide bars 58 are secured to housing 65. In the housing 65 is rotatively located drive shaft 66 which terminates in drive roll 68. Opposite drive roll 68 is clamping roll 70 slideably located. The slide, holding clamping roll 70, is mounted on top of housing 65 and actuated by clamping motor 72. The endless track 82 of the sole holding fixture S is clamped or released by the action of clamping motor 72. Holding fixture S and crossbar 36 are rotatively placed in the U-shaped link 74 (FIG. 6, FIG. 7). Drive shaft 66 is connected with the gear box 76 by means of universal joint 78 allowing the drive shaft 66 to follow the horizontal movement of housing 64. Gear box 76 receives its power input from electrical motor 80.

An important feature of this machine is the endless track 82 shown in FIGS. 2 to 7. The basic function of the endless track will be explained with reference to the schematic drawing of FIG. 2. The dotted lines indicate the shape of the endless track 82 which comprises two semi-circular sections with the short axis 84 and a straight section with the long axis 86. The short axis 84 are fixed and approximately equivalent to the diameter of the heel or toe area of the sole 34. However, the length of the long axis 86 is adjustable so that the overall length of the endless track can always be adjusted according to the overall length of different sole sizes. A pair of rolls, drive roll 68 and clamping roll 70, engage the endless track 82. In operation, the drive roll means the endless track perpendicular to the line 88. The means that when a semicircle of the endless track reaches the drive roll 68, said track will be swung around 180°.

Figure 2:
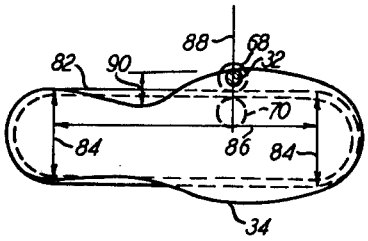
FIG. 2 is a schematic representation of the workpiece and the drive means.
Figure 3:
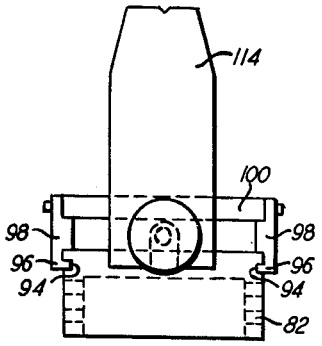
FIG. 3 is an end view of the adjustable track and a locating plate.

FIG. 2 reveals that the contour of the sole 34 deviates from the contour of the endless track 82; some portions of the sole edge lie inside of the endless track, others lie outside. In FIG. 2 the longest deviation is demonstrated by the distance 90. In our roughing machine, the roughing tool 32 is horizontally stationary. In order to maintain the same distance between the roughing tool 32 and the edge of the sole 34, the position of the sole must be corrected along the line 88. The maximum correction needed corresponds the distance 90. But, this linear correction can be made at a relatively low speed, since it has to be made when the edge of the sole travels along the roughing tool from its longest distance outside of the endless track to its longest distance inside of the track.

It is important to maintain a low speed for the correction of the sole position since with the increase of speed the acceleration forces grow quadratically and therefore causes inaccuracy of the sole guiding system. Furthermore, for the same reason it is of great importance that the endless track can be adjusted to the length of any shoe sole size, because by this adjustability it is possible to keep the deviation between the heel and toe area of the sole and the semi-circular sections of the track very small, obtaining an even more accurate position relative to the roughing tool 32.

Figure 4:
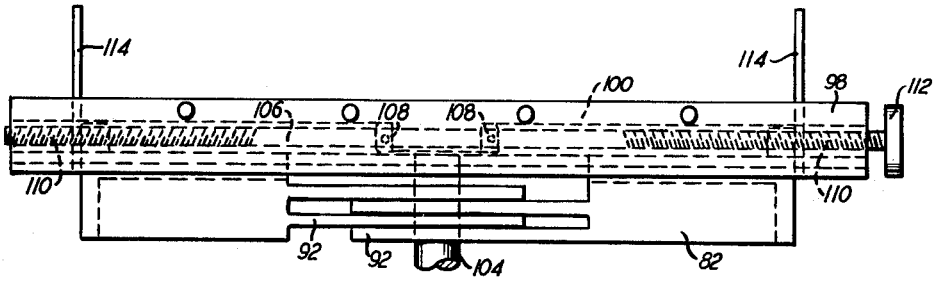
FIG. 4 is a side view of the adjustable track and the locating plates.
Figure 5:
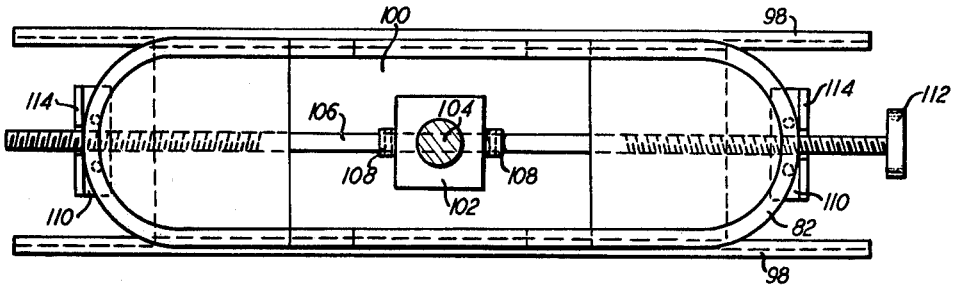
FIG. 5 is a plan view of the adjustable track and the locating plates.

The physical shape of the endless track 82 is revealed in FIG. 3 to FIG. 7. The endless track 82 consists of two halves, each half having the approximate shape of a horse shoe. The straight ends of each half terminate in extended fingers 92. The fingers 92 of each half are offset to each other so that they can engage and ensure that the axes of the endless track lie in the same plane. The engaging fingers 92 constitute mostly the rectangular section of the endless track 82 and the amount of this engagement determines the overall length of the endless track. Each half of the endless track has a slide way (FIG. 3) and can slide on a key 96 of the guide bars 98. The guide bars 98 are solidly bolted to a center plate 100. The center plate 100 has also a protrusion 102 and a shaft 104 (FIG. 5). Rotatively located in the protrusion 102 is adjustment screw 106 which is prevented from longitudinal movement by a pair of shoulders 108. The left hand and right hand threaded ends engage a corresponding nut 110 which is screwed onto the ends of the endless track. When the adjustment screw 106 is turned by the knob 112, it will simultaneously move both halves of the endless track toward or away from the center of the center plate 100, each half of the track moving an equal distance. In operation, the fingers 92 always stay engaged so that the drive roll 68 does not lose its grip. A locating plate 114 is mounted at each end of the endless track. When properly adjusted, the distance between the locating plate 114 will correspond to the length of the sole to be roughed.

In FIG. 6 and 7 is shown the suspension of the endless track 82 in the U-shaped link 74 of the suspension. Shaft 104 is rotatively located in the lower leg of the U-shaped link 74, and since the shaft 104 is holding the endless track, the clamping means, and the sole, the entire sole-holding fixture S can rotate around pivot pin 116 (FIG. 6).

The shaft 104 and the pin 116 are coaxial so that the fixture S and the crossbar, 36, together with the sole 34, can rotate in unison about the axis of the shaft 104 and the pin 116. The upper leg and the lower leg of the U-shaped link 74 have an additional portion 118 in order to increase the clearance for the roughing tool during the roughing operation. The linkage consists of U-shaped link 74, intermediate link 120 and stationary link 122 which is mounted on column 2. Intermediate link 120 can swing around pivot pin 124, and U-shaped link 74 can swing around pivot pin 126. This arrangement gives complete freedom to holding fixture S and crossbar 36 in a horizontal plane. This freedom of movement is necessary to enable the pair of rollers 68 and 70 to move the endless track 82 in a direction which is essentially perpendicular to a line 88 which is shown in FIG. 2.

Figure 8:
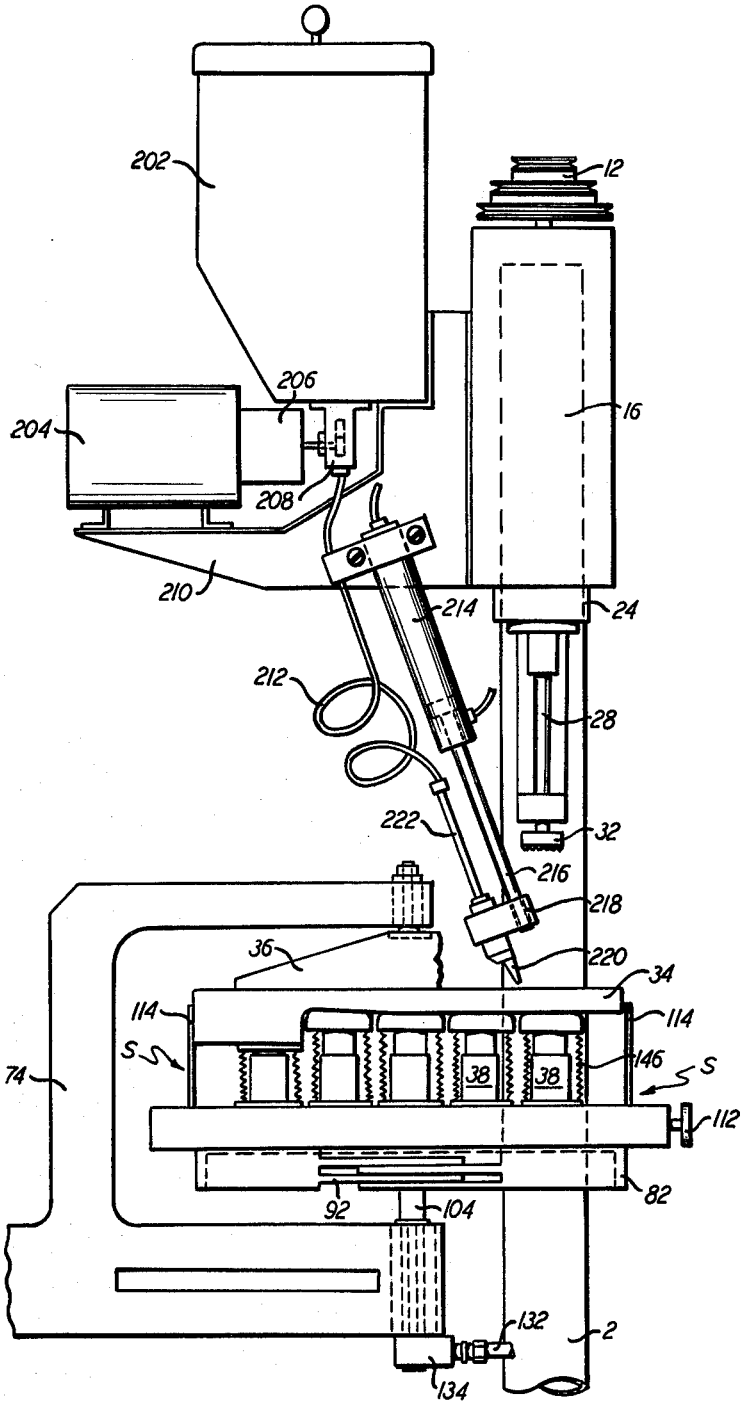
FIG. 8 is an elevation of the machine showing the workpiece treating means as being selectively usable roughing means and cement applying means.

FIG. 8 shows a cementing apparatus which is bolted to the housing 16 of the machine. Essentially, it consists of cement pot 202, drive motor 204, gear box 206, gear pump 208, flexible hose 212, air motor 214, piston rod 216, applicator housing 218, cement applicator 220, pipe 222 and bracket 210. The control means for the cementing apparatus are incorporated in the control system of the machine but will not be described in detail. The most commonly used cements for sole attaching are neoprene or polyurethane cements. The cementing apparatus is located in such a way that the extended piston rod 216 will hold the cement applicator 230 during the cementing operation above the path which was roughed before by the roughing tool 32. FIG. 8 shows the shoe sole 34 in a clamped position whereby the surface of the shoe sole to be roughed and cemented has been made straight.

Various methods could be used to hold the shoe sole 34 on top of the adjustable endless track 82. However, a practical method has been found in the test machine which consists of a multitude of clamping motors 38 which press the sole 34 against the crossbar 36. FIG. 7 illustrates a section through one of the clamping motors which will be used to explain its details. The clamping motors 38 in FIG. 7 are shown in a retracted position. When a corresponding foot valve (not shown in the drawings) is actuated, pressurized air flows through line 132, swivel 134 and a bore 136 going through the center of shaft 104. Bore 136 intersects a bore 138 which is drilled through the center of center plate 100. Each clamping motor 38 has a small drilled hole which intersects bore 138. Of course, all open ends of the air-carrying bores are sealed by plugs or o-rings to prevent leakage. The air motor 38 comprises an interior housing 140 which is bolted to the center late 100 and an exterior housing 142 which is slidably located around the interior housing 140. A shoulder screw 144 is fastened into the center of exterior housing 142 and slides in a corresponding counter bore of the interior housing 140. Shoulder screw 144 terminates the stroke of the motor 38 when said motor is powerized. Springs 146 can retract the extended exterior housing 142 as soon as the motors are de-powerized. On top of the exterior housings 142 are mounted spacers 148 of various thicknesses which make up for the various thicknesses of the sole 34. The shoulder screw 144 has sufficient clearance against the inside of the interior housing 140 so that air can by-pass. Thus the air pushes the ceiling of the exterior housing 142 upwardly against the sole 34. When all motors are simultaneously powerized by air or any other power-carrying liquid they force the sole 34 against the crossbar 36 thus straightening the surface which is to be roughed and cemented, but also clamping and holding it. In the powerized condition, crossbar 36, sole 34, motors 38 and endless track 82 have overcome one unit which can rotate around a vertical axis and also move freely in the horizontal plane. It is a great advantage that the surface to be roughed and cemented in straight during the roughing and cementing operation since the roughing tool or any other tool performs better on a straight surface than on a curved surface.

Now, the sequence of actions of this machine will be described. We will describe the actions in conjunction with a roughing tool and a cement applicator. In a powerized, however idle condition, the motor 52 (FIG. 1) is extended and pushes the spool of sensing valve 44 to the left via linkage 42. This way, air is directed to the piston side of motor 54 moving the fixture S toward the operator. Motor 72 is de-energized so that the endless track 82 can slide freely between the clamping roll 70 and drive roll 68. Roughing tool 32 is lifted up by the action of motor 26. Also, cement applicator 220 is retracted by the action of motor 214. Electrical motor 6 is running all the time; electrical motor 80 is running intermittently.

While the machine is in this starting condition, an operator places the sole 34 on top of the retracted clamping motors 38. By means of knob 112 he adjusts the endless track 82 to the length of the sole, controlling the adjustment by watching the locating plates 114 (FIG. 7). The importance of moving the locating plates 114 simultaneously with an equal distance toward or away from a stationary point in the center of the fixture S must be pointed out again. This way, the balance of the rotative fixture S and the sole 34 with their center of mass coinciding with (FIG. 6) is being maintained. Also, shoe soles are graduated from the middle which means that the middle of all shoe soles will be located always on the clamping motor 38 in the center of the fixture S. Now, the center of a shoe sole and the center of the fixture S are common reference points when the fixture has to be modified due to various heel heights. Once the sole 34 is properly aligned, the operator actuates a foot valve (not illustrated) whereby the clamping motors 38 extend and press the sole against the crossbar 36. This way, the sole is clamped, but its roughing surface is also straightened (see FIG. 8). Automatically following, the motor 72 is energized clamping the endless track by means of the clamping roll 70, and motor 52 is de-energized allowing spring 43 of valve 44 to push its spool, the linkage 42, and the sensing roll 40 into the direction of the sole 34. By this movement of the spool in the housing of valve 44, air in the piston side of motor 54 is released and the cap side in the motor 54 energized whereby said motor pulls the fixture S and thus sole 34 inwardly, i.e. toward the column of the machine. When the sole 34 is pulled inwardly its edge will move against the extended sensing roll 40 of the linkage 42. In doing so, the sole overcomes the force of spring 43 and pushes the spool of sensing valve 44 to the left. As soon as the spool of valve 44 reaches the neutral position in the housing of the valve, motor 54 stops moving, thus also halting fixture S and sole 34. At this point the sole is under the roughing tool ready to receive a roughing path exactly along the periphery of the sole. The point of stoppage can be changed by screw adjustment 50 of the sensing slide 46.

When the inward movement of sole 34 stops, motor 26 lowers roughing tool 32 and forces it with a predetermined pressure against the sole. Immediately after the roughing tool 32 touches the sole, motor 80 is automatically switched on and forces the holding fixture S to move under the rotating roughing tool via a belt, gear box 76, universal joint 78, drive shaft 66 and drive roll 68. Now the fixture S follows a path determined by the shape of the endless track and the corrections made by the novel guiding system during the roughing operation. These corrections are done as follows: Sensing roll 40, suspended by the four-bar linkage 42, is continuously forced against the edge of the sole. This rather light force is generated by the compression spring 43 of sensing valve 44. During the roughing operation, the guiding system of this machine always tends to keep the spool of the sensing valve 44 in a neutral position. Assuming, due to the shape of the shoe sole, the sensing roll 40 moves outwardly, i.e. away from the column 2. Then, spring 43 will also move the spool of the sensing valve 44 outwardly, thereby letting air bleed out of the piston side of motor 54 and letting air come into the cap side of motor 54. This causes an immediate movement of the piston to the left (when looking at FIG. 1) thus also moving fixture S and the sole to the left, i.e. bringing back sensing roll 40, linkage 42 and the spool sensing valve 40 into a neutral position.

As soon as the drive roll 68 in conjunction with the clamping roll 70 has moved the endless track and thus the sole all around under the roughing tool, the roughing operation is stopped and the roughing tool 32 is lifted. Immediately afterwards, motor 214 extends piston rod 216 thus bringing cement applicator 220 into a cementing position. Simultaneously, motor 204 begins to drive gear pump 208 and forces cement through the flexible hose 212, pipe 222, and the cement applicator 220 onto the shoe sole. Also, at the same instant, motor 80 again starts moving the endless track 82 until the cement has been applied all around the shoe sole. Then, the machine stops automatically and all involved parts move back into starting position.

There follows a recapitulation of the description of the machine and its mode of operation that pertain to this invention.

The machine is intended to move a workpiece (the sole 34) past a work treating means (the roughing tool 32 or the cement applicator 220). The machine includes the fixture S adapted to support the workpiece 34. Means comprised of the shaft 104, the links 74, 120 and 122 and the column 2 mount the fixture S for universal movement in a prescribed (horizontal) plane. The track 82 is formed of two sections that are mounted to the fixture S for movement towards and away from each other. The track sections are comprised, as shown in FIGS. 4 and 5, of facing concave end portions and overlapping finger portions 92 that extend from opposite ends of the concave end portions. A locating plate 114 is mounted to each concave track portion and extends upwardly of the fixture S. The screw 106 forms adjusting means for concurretly moving the track sections and the locating plates towards and away from each other. The workpiece treating means 32 or 220 is so located as to treat a part of the workpiece 34 proximate to its periphery as the workpiece part moves past the workpiece treating means. The rolls 68 and 70 act as drive means cooperate with the track sections as to so move the fixture in said prescribed plane as to move successive segments of the workpiece part past the workpiece treating means. The overlapping finger portions 92 comprise offset fingers and the rolls 68 and 70 are engageable with the opposite sides of the track sections. The mounting of the track sections to the fixture S for movement towards and away from each other and the adjusting means comprise the pair of guide bars 98 on which the finger portions 92 are mounted for movement, the center plate 100 secured to the guide bars, and the adjustment screw 106 rotatably mounted to the center plate and having oppositely threaded ends that are threaded into the concave end portions of the track sections.

The machine includes the crossbar 36, which functions as a hold-down bar. The hold-down bar 36 has a flat bottom and a prescribed length (see FIG. 7), is located above the fixture S and is adapted to bear against the top of the workpiece 34. The housings 142 form a plurality of plungers, adapted to support the workpiece 34, mounted to the fixture S for heightwise movement and located side by side beneath the hold-down bar 36, the plungers 142 having an overall length corresponding to the prescribed length of the hold-down bar 36 (see FIG. 7). The springs 46 act as means for initially maintaining the plungers 142 in lower positions and pressurized air flowing through the line 132 acts as means for yieldably urging the plungers 142 upwardly to thereby press the workpiece 34 against the flat bottom of the hold-down bar 36 and thus flatten the workpiece against the hold-down bar. The hold-down bar 36 is mounted by the pin 116 to the link 74 to enable the hold-down bar to have universal movement in a plane parallel to the universal plane of movement of the fixture S.

The column 2 forms a fixed structure. The fixture S is mounted to the link 74 for rotary movement about the heightwise axis of the shaft 104, this axis intersecting the fixture S proximate to its center of mass. The links 120 and 122 form a linkage swingably connecting the link 74 to the fixed structure 2. The mounting of the fixture S to the link 74 and the linkage swingably connecting the link 74 to the fixed structure 2 are so constructed and arranged as to mount the fixture S for universal movement in a prescribed plane that is at right angles to the axis of the shaft 104. The hold-down bar 36 is mounted to the link 74 for rotary movement about the axis of the pin 116, which axis is coaxial with the axis of the shaft 104.

Having thus described our invention what we claim as new and desired to secure by Letters Patent of the United States is:

1. A machine for moving a workpiece past a workpiece treating means comprising: a fixture adapted to support the workpiece; means mounting the fixture for universal movement in a prescribed plane; a pair of track sections, mounted to the fixture for movement towards and away from each other, comprised of facing concave end portions and overlapping finger portions that extend from opposite ends of the concave end portions; a locating plate mounted to each concave portion and extending upwardly to the fixture; adjusting means for concurrently moving the track sections and the locating plates towards and away from each other; a workpiece treating means so located as to treat a part of the workpiece proximate to the workpiece periphery as said workpiece part moves past the workpiece treating means; and drive means; and drive means cooperative with the track sections as to so move the fixture in said prescribed plane as to move successive segments of said workpiece part past the workpiece treating means.

2. The machine of claim 1 wherein said overlapping finger portions comprise offset fingers and wherein said drive means comprises rolls engageable with the opposite sides of the track sections.

3. The machine of claim 1 wherein the mounting of the track sections to the fixture of movement towards and away from each other and said adjusting means comprise: a pair of guide bars on which said finger portions are mounted for movement; a center plate secured to the guide bars; and an adjustment screw, having oppositely threaded ends that are threaded into said concave end portions, rotatably mounted to the center plate.

4. A machine for moving a workpiece past a workpiece treating instrumentality comprising: a fixture adapted to support the workpiece; means mounting the fixture for universal movement in a prescribed plane; a pair of track sections, mounted to the fixture for movement towards and away from each other, comprised of facing concave end portions and overlapping offset fingers that extend from opposite ends of the concave end portions; adjusting means for moving the track sections toward and away from each other; a workpiece treating means so located as to treat a part of the workpiece proximate to the workpiece periphery as said workpiece periphery moves past the workpiece treating means, and rolls engageable with opposite sides of the track sections effective to so move the fixture in said prescribed plane as to move successive segments of said workpiece past the workpiece treating means.

5. The machine of claim 4 wherein the mounting of the track sections to the fixture for movement towards and away from each other and said adjusting means comprises: a pair of guide bars on which said finger portions are mounted for movement; a center plate secured to the guide bar; and an adjustment screw, having oppositely threaded ends that are threaded into said concave end portions, rotatably mounted to the center plate.

6. A machine for moving a workpiece past a workpiece treating means comprising: a fixture, a hold-down bar, having a flat bottom and a prescribed length, located above the fixture and adapted to bear against the top of the workpiece; a plurality of plungers, adapted to support the workpiece, mounted to the fixture for heightwise movement and located side by side beneath the holddown bar, the plungers having an overall length corresponding to said prescribed length; means for initially maintaining the plungers in lower positions; means for yieldably urging the plungers upwardly to thereby press the workpiece against the flat bottom of the hold-down bar and thus flatten the workpiece against the hold-down bar; a workpiece treating means so located as to treat the part of the workpiece proximate to the workpiece periphery as said workpiece periphery moves past the workpiece treating means; means mounting the fixture and the hold-down for universal movement in prescribed parallel planes; and drive means effective to so move the fixture and the hold-down in said prescribed planes as to move successive segments of said workpiece part past the workpiece treating means.

7. A machine for moving a workpiece past a workpiece treating means comprising: a fixture adapted to support the workpiece; a fixture structure; a link; means mounting the fixture to said link for rotary movement about a heightwise axis that intersects the fixture proximate to its center of mass; and linkage swingably connecting the link to the fixed structure; said fixed structure, said means mounting the fixture to said link, and said linkage being so constructed and arranged as to mount the fixture for universal movement in a prescribed plane that is at right angles to said axis; a workpiece treating means so located as to treat a part of the workpiece proximate to the workpiece periphery as said workpiece part moves past the workpiece treating means; and drive means effective to so move the fixture in said prescribed plane as to move successive segments of said workpiece part past the workpiece treating means.

8. The machine of claim 7 further comprising: a hold-down bar, located above the fixture and adapted to bear against the top of the workpiece, mounted to said link for rotary movement about said axis; means for initially retaining the fixture and the hold-down bar in relatively open positions spaced from each other; and means for imparting relative closing movement of the fixture and the hold-down bar to clamp the workpiece therebetween.

* * * * *

UNITED STATES PATENT AND TRADEMARK OFFICE

CERTIFICATE OF CORRECTION

PATENT NO. : 4131965

DATED : January 2, 1979

INVENTOR(S) : Henry von den Benken et al

It is certified that error appears in the above–identified patent and that said Letters Patent are hereby corrected as shown below:

Column 8: line 41, delete "and drive means;"

Signed and Sealed this

*Third* Day of *April 1979*

[SEAL]

*Attest:*

RUTH C. MASON
*Attesting Officer*

DONALD W. BANNER
*Commissioner of Patents and Trademarks*